US005802753A

United States Patent [19]

Raunisto

[11] Patent Number: 5,802,753

[45] Date of Patent: Sep. 8, 1998

[54] QUICK COUPLING ASSEMBLY

[76] Inventor: Yrjö Raunisto, Anttilankatu 13, FIN-13210, Hämeenlinna, Finland

[21] Appl. No.: 687,601

[22] PCT Filed: Feb. 9, 1995

[86] PCT No.: PCT/FI95/00053

§ 371 Date: Aug. 8, 1996

§ 102(e) Date: Aug. 8, 1996

[87] PCT Pub. No.: WO95/21969

PCT Pub. Date: Aug. 17, 1995

[30] Foreign Application Priority Data

| | | | |
|---|---|---|---|
| Feb. 9, 1994 | [FI] | Finland | 940608 |
| Sep. 13, 1994 | [FI] | Finland | 944214 |

[51] Int. Cl.[6] ..... E02F 3/96

[52] U.S. Cl. ..... 37/468; 92/117 R; 92/111; 172/273; 414/723

[58] Field of Search ..... 37/468, 403; 414/723; 172/272, 273; 403/322, 24; 92/117 R, 51, 111

[56] References Cited

U.S. PATENT DOCUMENTS

| | | | |
|---|---|---|---|
| 3,705,656 | 12/1972 | Hunger et al. . | |
| 4,586,867 | 5/1986 | Stafford | 414/723 |
| 4,772,150 | 9/1988 | Horton | 37/468 X |
| 5,049,027 | 9/1991 | Morrison et al. | 414/723 |
| 5,224,553 | 7/1993 | Heintzman | 172/556 |
| 5,310,275 | 5/1994 | Lovitt | 37/468 X |
| 5,419,673 | 5/1995 | Merhar | 37/468 X |
| 5,511,329 | 4/1996 | Mickelson | 37/468 |
| 5,529,419 | 6/1996 | Gebauer | 37/468 X |
| 5,546,683 | 8/1996 | Clark | 37/468 |
| 5,562,397 | 10/1996 | Albright | 37/468 X |
| 5,590,483 | 1/1997 | Kim | 37/468 |

FOREIGN PATENT DOCUMENTS

| | | |
|---|---|---|
| 0 333 066 | 9/1989 | European Pat. Off. . |
| 0 615 023 | 9/1994 | European Pat. Off. . |
| 41 02 370 | 8/1991 | Germany . |
| 501 152 | 11/1994 | Sweden . |

*Primary Examiner*—Terry Lee Melius
*Assistant Examiner*—Victor Batson
*Attorney, Agent, or Firm*—Larson & Taylor

[57] ABSTRACT

A method to connect and disconnect a push-pull coupling in a push-pull assembly and a push-pull assembly for mounting a tool on a work machine. The tool comprises several attachment bushings for fitting of fulcrum pins into the bushings, by means of which the tool is attached to the work machine. The fulcrum pins are mounted on the work machine and are horizontally movable in opposite directions for insertion into and withdrawal from the attachment bushings.

7 Claims, 4 Drawing Sheets

QUICK COUPLING ASSEMBLY

This invention relates to a push-pull assembly and a method for automatic connection of the push-pull coupling of the assembly.

Previously known are pull-push assemblies for attaching scoops, bulldozer blades or other tools on work machines. Generally known is a connecting piece adapted to the work machine and furnished with hooks and a locking device. By means of the hooks the tool can be picked up, for instance, from the ground on fulcrum pins in the work machine, which match with the hooks in the tool and around which the hooks are wound. The connecting piece has also a locking device to secure the tool at least from another spot to the connecting piece. The attachment of a tool is carried out from the work machine cabin.

On using a connecting piece a disadvantage is the fact that the tool must be furnished with counter-pieces matching with the hooks. The connecting piece means increased weight, especially at the head of an excavator boom, and especially a decrease of the breaking strength of the excavator scoop while lengthening the boom arm which lengthens the scoop torque arm.

By means of a push-pull assembly according to this invention, these disadvantages are eliminated.

The advantages of this invention are that the tools can be quite normal scoops, bulldozer blades or percussion devices with usual mounting holes for fulcrum pins. No separate conneting piece is needed that would increase weight and lengthen the boom arm. Further, as by other push-pull means, mountings and tool replacements can be carried out from the work machine cabin. This push-pull assembly allows automatic coupling of pressure connectors and electric connectors.

In the following the invention is disclosed with reference to the enclosed drawing, where FIG. 1 is a side view of an excavator boom head and a scoop.

Figure 1:
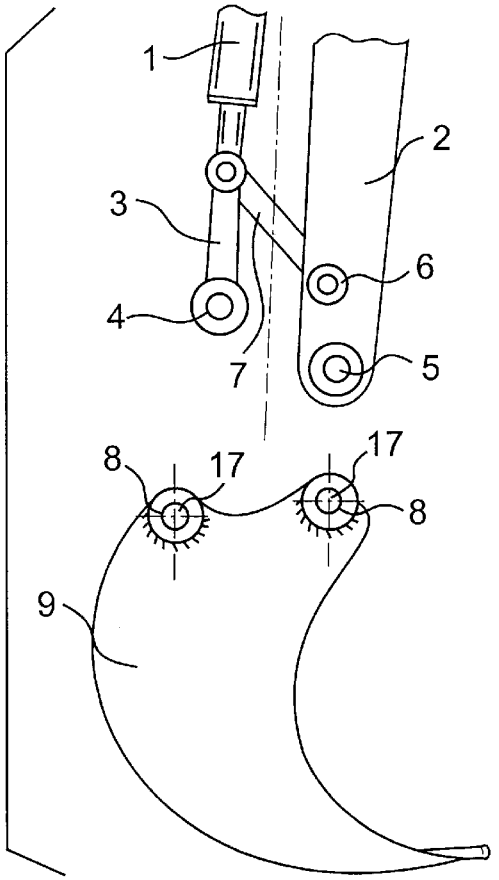

FIG. 1 shows the head of an excavator 2 boom to which scoop 9 is attached. Scoop 9 has two attachment lines 17 to which bushings 8 are applied. In the head of boom 2 there is an immobile mounting hole 5 matching with the pins of the assembly of this invention. Further, at the head of boom 2 there is a mobile mounting hole 4, into which the inventional assembly also fits. The mobile joint 4 is in one end of arm 3 and effected by cylinder 1. In addition, the boom 2 has a steering mechanism comprising an arm 7 and hole 6 to control the cylinder 1 head and allowing the scoop 9 greater clearance by means of arm 3.

Figure 2:
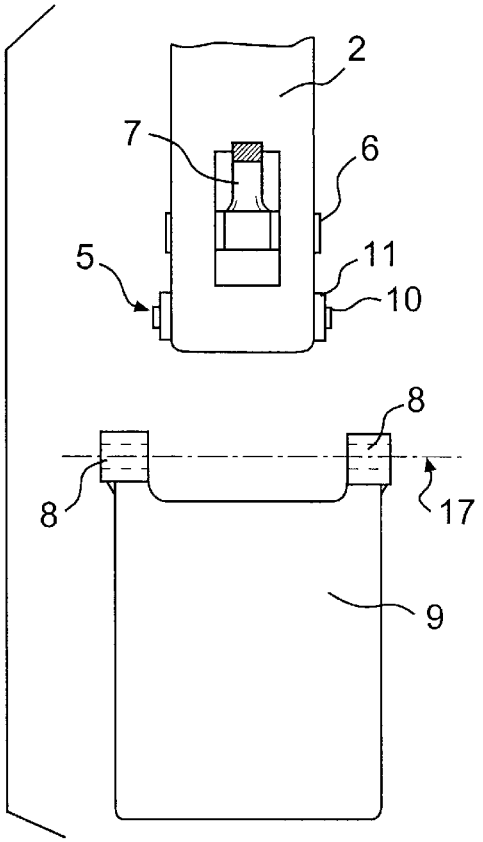
FIG. 2 is the inverted image of the details in FIG. 1.

FIG. 2 shows a boom head 2 in a position from where it is lowered to the attachment line 17 in scoop 9 in order to fit the pins 10 of mounting hole 5 into bushings 8. In the near vicinity of the of bushings 8 there can be control surfaces to facilitate the alignment of boom head and mounting hole 5 with attachment line 17. When the boom head has reached its proper position, the fulcrum pins 10 are pushed out from the mounting hole 5, whereat they are guided into bushings 8 and the tool 9 is locked in the boom head. Then the mounting hole 4 is secured in the same manner to the other scoop bushings 8 in pushing out the corresponding fulcrum pins 10 into the open ends of bushings 8 by means of compressed air or hydraulic pressure. Disconnection of tool is easily carried out simply by pulling in the fulcrum pins 10 by means of compressed air or hydraulic pressure.

Figure 3:
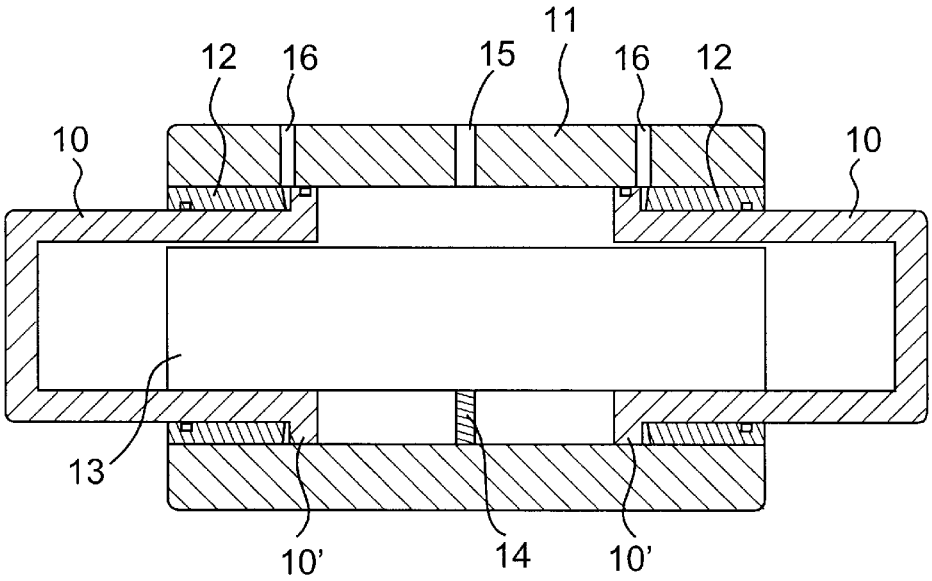
FIG. 3 is a sectional view of a-fulcrum pin assembly.

FIG. 3 shows a simple example of the push-pull assembly, where fulcrum pins 10 can be moved in and out. Fulcrum pins 10 having collars 10' are bushings moving on a shaft pin 13 supporting them from the inside. The immobility of shaft pin 13 is secured by fixing it by means of a support 14 to an outer bushing 11 that functions as a frame. Support 14 is a ring almost enveloping shaft pin 13 and preventing shaft pin 13 from bending in situations of stress. Pressure which causes pushing out of fulcrum pins 10 is conveyed along channel 15 to the ring space that is formed between the fulcrum pins 10. Pressure which causes pulling in of the fulcrum pins 10 is conveyed along channel 16 to the smaller ring spaces, where a force is generated by pressure against the fulcrum pin collars 10' which pushes them against each other. Separate bushings 12, which also have ring packings, are very important with respect to the composition of the assembly.

The assembly is attached from its outer bushing 11 to boom head 2 and likewise outer end of arm 3. On using a traditional tool, a scoop for example, two assemblies are needed one of each side of the scoop.

Figure 4:
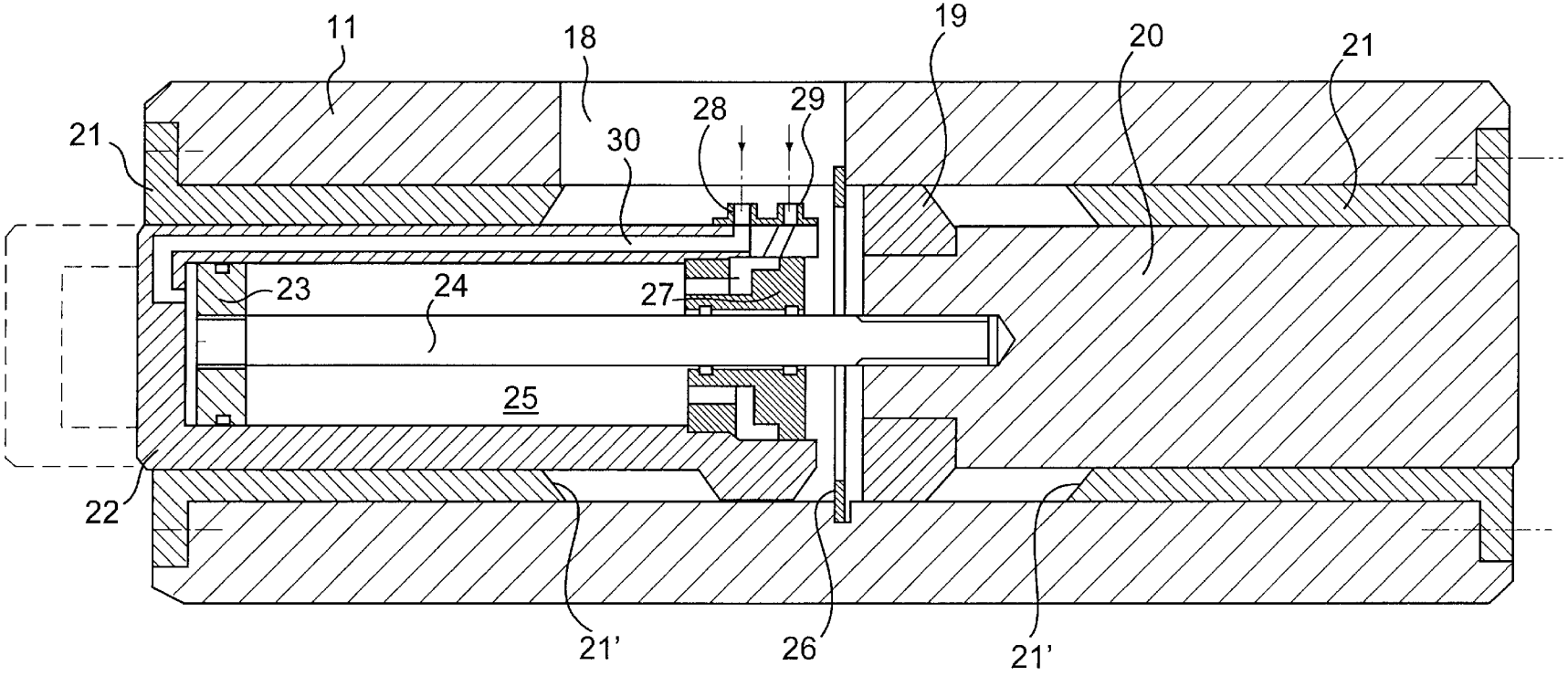
FIG. 4 is a sectional view of another fulcrum pin assembly embodiment.

FIG. 4 shows an advanced pin, which is a part of this push-pull assembly and operated by a pressure medium, the advantage of which is, relative to the FIG. 3 version, that the pushed-out pins 20, 22 need not to fit tightly to frame 11 or to guide bushings 21. In fact, the pressure of the medium does not have any impact on the gliding surface between them and no leakage occurs if the surfaces are damaged, which can be the case in the FIG. 1 version.

The pushing-out force of pins 20, 22 is conveyed through the inlet 28 into tube 30 and to the rear of piston 23. Piston rod 24 pushes out pin 20 against the conical stopper surface 21 between bushing 22 and ring 19. Due to pressure, both pins travel out and it is advantageous to leave the pressure active, whereat pins 20, 22 are supported by the conical surfaces of bushings 21.

The pressure feeding unit connected to pin 20 and support 27 of piston rod 24 move along with pin 22. In the middle of frame 11 there is a stop ring 26, due to which both pulled-in pins end up on both sides of the ring. The pulling-in of pins is carried out by conveying pressure through inlet 29 to cylinder space 25 in pin 22, whereby the pins travel to a position as per FIG. 4.

Figure 5:
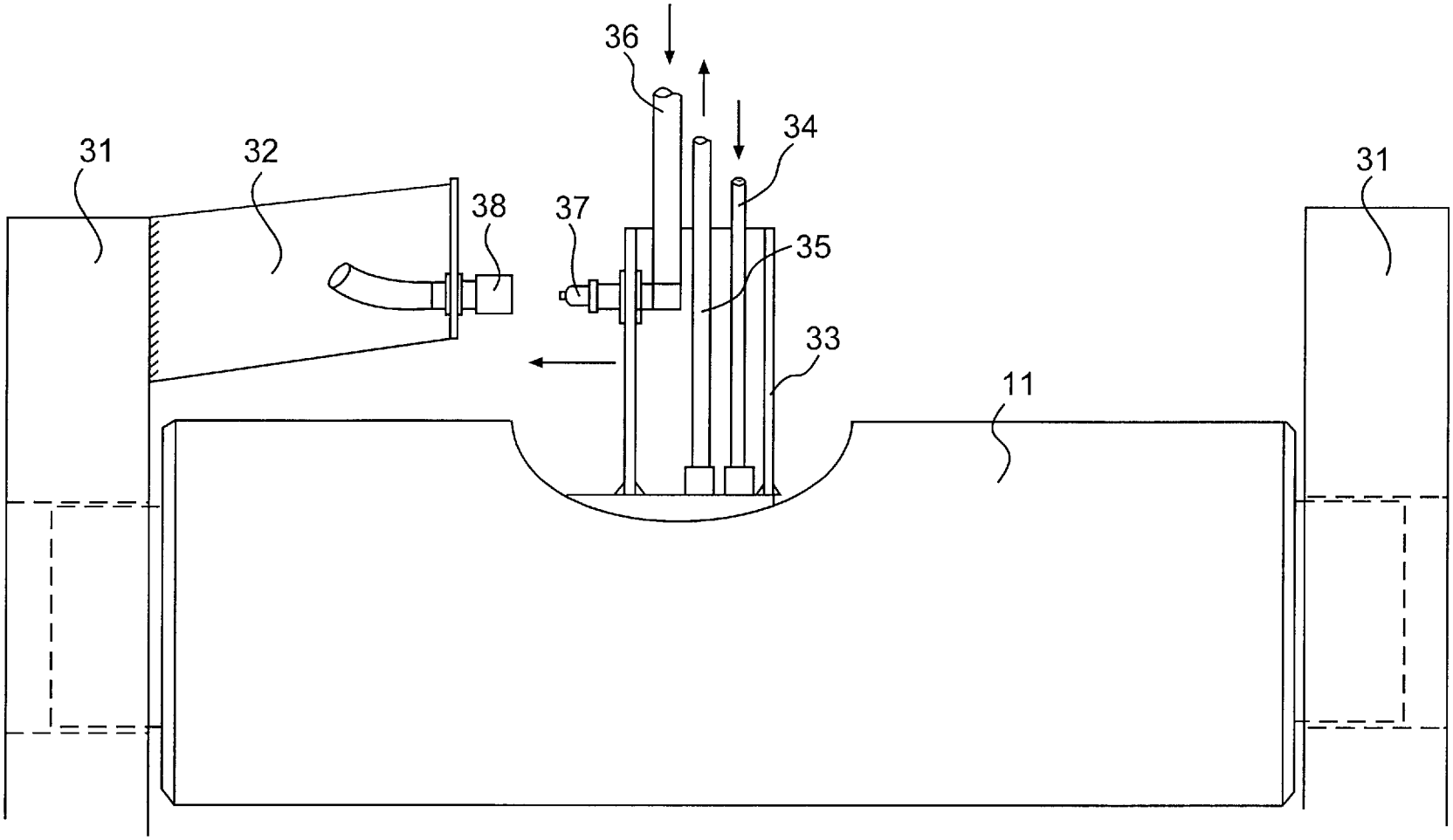
FIG. 5 is automatic connection of a pressure connector.

FIG. 5 shows an automatic pressure tube coupling that is added to the embodiment presented in FIG. 4, where the sideward motion of the pin causes coupling of the hydraulic connection 37, 38 as the pins travel out. The connector 37 is arranged to move along with pin 22 and is fixed by means of a special support frame 33 to pin 22. The motion of pins 20, 22 is guided by pressure medium flowing through tubes 34,35. The connector 38 is fixed to the work machine by means of support 32. To make the connector 37 hit connector 38, the assembly can be furnished with special guides to guide the connectors into interconnection. A necessary number, i.e. several connector pairs, can be coupled simultaneously. Pins 20 and 22 are forced outward by means of continuous pressure, whereby the coupling of connectors 37,38 remains connected. In addition to the continuous pressure effect, locking of couplings 38,37 can also be made otherwise, such as by mechanical means.

Figure 6:
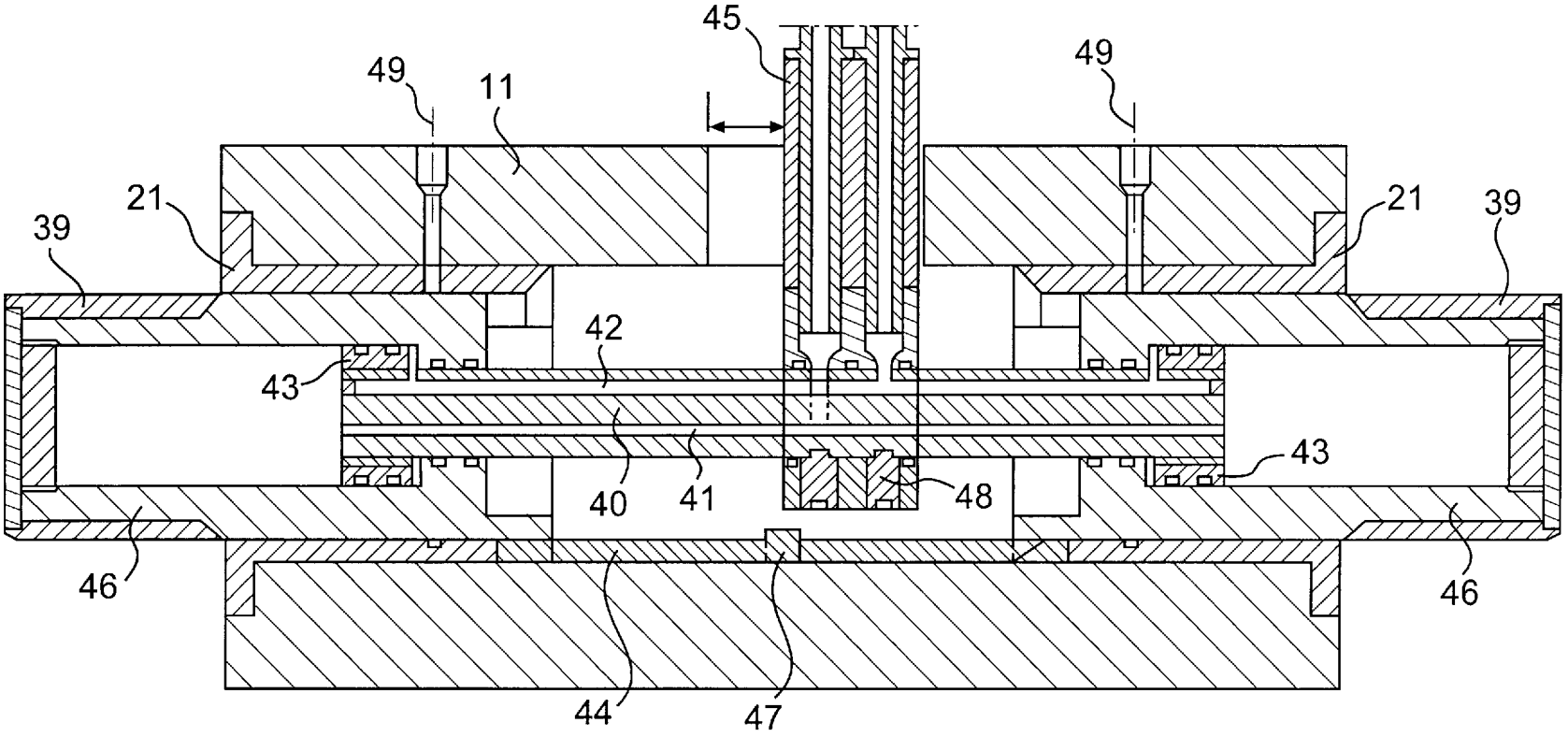
FIG. 6 is a sectional view of a third embodiment of the invention.

FIG. 6 shows a version, where movable pins 46 cannot rotate. Their heads are furnished with bushings 39 that rotate, if needed, on pins 46. Bushings 39 can be easily replaced, for instance, if worn out. Rotation of pins 46 is prevented by a stopper 44 fitted between bushings 21 in the bottom part of the frame. At this stopper the pins 46 have no conical extension. Instead, these conical extensions are on side portions of the pins that take support from the matching bevel face 21 of bushings 21 by the said portion of their sides. Also the upper edge of the pins is without an extension so that in the pulled-in position of the pins it stays in the slot between pins 46. In the stopper end there are notches for the pressure feeding unit 45. The stopper has also a bracket 47 to control the position of the pins when they are pulled-in. The pins are pulled in until their rear edges hit the bracket.

Piston rod 40 comprises pressure channels 42 for pushing out pins and its travel can also be utilized to couple one or several pressure connectors. Lubrication to the glide face of pins 46 can be conveyed over channels 49.

I claim:

1. A push-pull quick coupling pin assembly for mounting a tool on a work machine, comprising at least one pair of attachment bushings for fitting a corresponding pair of fulcrum pins for attaching the tool to the work machine, said assembly being fixed to the work machine and comprising two horizontally movable fulcrum pins arranged opposite each other, at least one of said pins comprising a cylinder of a double-acting pressure-actuated piston and cylinder.

2. An assembly according to claim 1 wherein a further pin of the fulcrum pin pair is fastened to a piston rod that is moved by a piston of said piston and cylinder.

3. An assembly according to claim 1 further comprising means for restricting travel of said pins outwardly away from each other.

4. An assembly according to claim 1 further comprising means for preventing rotation of said fulcrum pins during axial movement.

5. An assembly according to claim 4 further comprising replaceable bushings at outer ends of said fulcrum pins.

6. An assembly according to claim 1 further comprising coupling means for connecting a pressure tube or an electric cable to the push-and pull assembly, said coupling means comprising one part which is connected to the tool which is to be mounted and a further part which is connected to said cylinder or to said piston of said piston and cylinder for motion therewith, whereby coupling and uncoupling of said coupling means is effected by cylinder or said piston.

7. An assembly according to claim 6 further comprising means for supplying a pressure medium to said piston and cylinder for urging said fulcrum pins of the push-pull assembly outwardly away from each other when the tool is coupled by the pins to said work machine.

* * * * *